US010935295B2

(12) United States Patent
Saito et al.

(10) Patent No.: US 10,935,295 B2
(45) Date of Patent: Mar. 2, 2021

(54) ICE MAKING MACHINE

(71) Applicants: NIDEC SANKYO CORPORATION, Suwa-gun Nagano (JP); WHIRLPOOL CORPORATION, Benton Harbor, MI (US)

(72) Inventors: Shunji Saito, Suwa-gun Nagano (JP); Satoshi Tanimura, Suwa-gun Nagano (JP); Katsuhiko Hayashi, Suwa-gun Nagano (JP); David Vega, Nuevo Leon (MX)

(73) Assignees: NIDEC SANKYO CORPORATION, Nagano (JP); WHIRLPOOL CORPORATION, Benton Harbor, MI (US)

( * ) Notice: Subject to any disclaimer, the term of this patent is extended or adjusted under 35 U.S.C. 154(b) by 156 days.

(21) Appl. No.: 16/145,765

(22) Filed: Sep. 28, 2018

(65) Prior Publication Data

US 2019/0093935 A1 Mar. 28, 2019

Related U.S. Application Data

(60) Provisional application No. 62/564,733, filed on Sep. 28, 2017.

(51) Int. Cl.
*F25C 1/10* (2006.01)
*F25C 5/187* (2018.01)
(Continued)

(52) U.S. Cl.
CPC ..... *F25C 5/187* (2013.01); *F25C 1/10* (2013.01); *F25C 1/243* (2013.01); *F25C 5/06* (2013.01);
(Continued)

(58) Field of Classification Search
CPC .... F25C 5/22; F25C 5/187; F25C 1/10; F25C 1/243; F25C 1/08; F25C 1/25
See application file for complete search history.

(56) References Cited

U.S. PATENT DOCUMENTS 5,881,558 A * 3/1999 Kawahara ..... B60H 1/00692 454/156
6,732,537 B1 5/2004 Anell et al.
(Continued)

FOREIGN PATENT DOCUMENTS

JP H08261627 A 10/1996
JP 2004271047 A 9/2004

OTHER PUBLICATIONS

USPTO Non-Final Office Action for corresponding U.S. Appl. No. 16/145,810 ;dated May 13, 2020.
(Continued)

*Primary Examiner* — Elizabeth J Martin
*Assistant Examiner* — Nael N Babaa
(74) *Attorney, Agent, or Firm* — Cantor Colburn LLP

(57) ABSTRACT

An ice making machine may include an ice tray, a drive unit which is provided at one end of the ice tray and is structured to turn the ice tray, a frame body which supports the ice tray and the drive unit, and a cold air duct which connects an opening formed in the frame body with the cold air supply port. The frame body is provided with a wall part which faces the drive unit at the other end of the ice tray and the opening is formed in the wall part. The cold air duct is provided with an inclined flow passage part inclined with respect to a direction where an ice making recessed part in the ice tray is opened, and the inclined flow passage part is provided with a cold air blowing outlet which faces the ice making recessed part.

13 Claims, 7 Drawing Sheets

(51) Int. Cl.

| | |
|---|---|
| ***F25D 17/06*** | (2006.01) |
| ***F25C 1/243*** | (2018.01) |
| ***F25C 5/20*** | (2018.01) |
| ***F25D 29/00*** | (2006.01) |
| ***F25C 5/06*** | (2006.01) |

(52) U.S. Cl.
CPC ..... *F25C 5/22* (2018.01); *F25D 17/065* (2013.01); *F25D 17/067* (2013.01); *F25D 29/005* (2013.01); *F25B 2600/112* (2013.01); *F25C 2400/10* (2013.01); *F25D 2317/063* (2013.01); *F25D 2317/067* (2013.01)

(56) References Cited

U.S. PATENT DOCUMENTS

| | | | | |
|---|---|---|---|---|
| 7,762,092 | B2 † | 7/2010 | Tikhonov | |
| 2011/0146312 | A1 * | 6/2011 | Hong | F25C 5/182 62/137 |
| 2016/0258664 | A1 * | 9/2016 | Visin | F25C 1/243 |
| 2017/0307270 | A1 * | 10/2017 | Kim | F25C 1/24 |
| 2018/0224184 | A1 | 8/2018 | Mitchell | |
| 2019/0086134 | A1 * | 3/2019 | Lee | F25C 5/24 |

OTHER PUBLICATIONS

USPTO Non-Final Office Action for corresponding U.S. Appl. No. 16/145,784 ;dated Jun. 1, 2020.

* cited by examiner
† cited by third party

ICE MAKING MACHINE

CROSS REFERENCE TO RELATED APPLICATION

The present application claims priority under 35 U.S.C. § 119(e) to U.S. provisional application 62/564,733 filed Sep. 28, 2017 the entire content of which is also incorporated herein by reference.

FIELD OF THE INVENTION

At least an embodiment of the present invention may relate to an ice making machine structured to blow cold air to an ice tray for making ice.

BACKGROUND

A freezer or a refrigerator having a refrigerating chamber and a freezing chamber is sometimes mounted with an automatic ice making machine in which ice is made and the ice is supplied to an ice storage container provided in an inside of the freezer or the refrigerator. The ice making machine is disposed in an ice making chamber provided in a freezer or a refrigerator. A cold air blowing outlet is provided in the ice making chamber and cold air is supplied to the ice making chamber through the cold air blowing outlet. The ice making machine includes an ice tray and a water supply mechanism structured to supply water to the ice tray and the water supplied to the ice tray is frozen by cold air supplied through the cold air duct to make ice.

The ice making machine is disclosed in Japanese Patent Laid-Open No. 2004-271047 and Japanese Patent Laid-Open No. Hei 8-261627. A refrigerator disclosed in the former Patent Literature includes an ice making machine (automatic ice making device). This ice making machine is integrally formed with a cold air duct in an upper part of an ice tray. An ice making chamber is connected with a cold air passage and cold air supplied to the ice making chamber through the cold air passage is guided into the cold air duct and is flowed over the ice tray.

Further, in the latter Patent Literature, a refrigerator is disclosed in which a cold air duct separately provided from an ice tray is provided above the ice tray. The cold air duct is provided closely to the ice tray and thus cold air is supplied to the vicinity of a water surface of the ice tray.

In the former Patent Literature, although a cold air duct is integrally formed in an upper part of the ice tray, an air passage from a cold air passage to a cold air duct is structured of a space between a wall for partitioning the ice making chamber and the ice making machine. In this structure, when an outward shape of the ice making machine is changed or, when arrangement of the ice making machine in an inside of the ice making chamber is changed, cold air may not be effectively supplied to the cold air duct from the cold air passage.

Further, also in the latter Patent Literature, in a case that arrangement of an ice tray in an inside of the ice making chamber is changed or, in a case that a position of a cold air inlet on a side of the refrigerator with which a cold air duct is connected is changed, a positional relationship between the ice tray and the cold air duct is changed and thus cold air may be unable to be supplied to the vicinity of a water surface of the ice tray.

Further, in the former and latter Patent Literatures, the cold air duct provided above the ice tray regulates a flow of cold air to supply the cold air to respective parts of the ice tray. However, the cold air duct covering the upper part of the ice tray is large and its shape is complicated. Therefore, the ice making machine becomes large and its structure is complicated.

SUMMARY

In view of the problem described above, at least an embodiment of the present invention may advantageously provide an ice making machine which is capable of effectively supplying cold air to an ice tray in a simple structure to improve an ice making efficiency.

According to at least an embodiment of the present invention, there may be provided an ice making machine disposed in an ice making chamber provided with a cold air supply port to which cold air is supplied. The ice making machine includes an ice tray, a drive unit which is provided at one end in a longitudinal direction of the ice tray and is structured to turn the ice tray, a frame body which supports the ice tray and the drive unit, and a cold air duct which connects an opening formed in the frame body with the cold air supply port. The frame body is provided at the other end in the longitudinal direction of the ice tray with a wall part which faces the drive unit, and the opening is formed in the wall part.

According to at least an embodiment of the present invention, the frame body which supports the ice making machine and the cold air supply port which is provided in the ice making chamber are connected with each other through the cold air duct and thus cold air can be effectively supplied to an inner side of the frame body. Further, the cold air duct is connected by utilizing the wall part of the frame body and thus cold air can be effectively supplied to the vicinity of the ice tray in a simple structure. Therefore, ice making efficiency can be enhanced. Further, cold air is supplied from an end part in a longitudinal direction of the ice tray and thus cold air can be effectively spread over the ice tray.

In at least an embodiment of the present invention, it is desirable that the cold air duct is provided with an inclined flow passage part which is inclined with respect to a direction where an ice making recessed part provided in the ice tray is opened, and the inclined flow passage part is provided with a cold air blowing outlet which faces the ice making recessed part. According to this structure, cold air can be obliquely blown to the ice making recessed part. Therefore, ice making efficiency can be enhanced.

In at least an embodiment of the present invention, it is desirable that the inclined flow passage part is provided with a lower inclined wall disposed in the opening and an upper inclined wall facing the lower inclined wall, and the lower inclined wall and the upper inclined wall are inclined with respect to the direction where the ice making recessed part is opened. According to this structure, cold air is obliquely blown downward between the upper inclined wall and the lower inclined wall and thus the cold air can be obliquely blown to the ice making recessed part.

In at least an embodiment of the present invention, it is desirable that the ice tray is provided with a plurality of the ice making recessed parts which are arranged in the longitudinal direction of the ice tray, and a tip end of the lower inclined wall is directed in a direction between the wall part and the ice making recessed part which is located at the closest position to the wall part. Alternatively, it is desirable that the ice tray is provided with a plurality of the ice making recessed parts which are arranged in the longitudinal direction of the ice tray, and the cold air blowing outlet faces the ice making recessed part which is located at the closest position to the wall part. According to this structure, cold air can be blown to the ice making recessed part which is located at the most front side when viewed from the wall part side. Therefore, a flow of cold air can be made from the wall part side of the ice tray toward the drive unit side and thus the cold air can be efficiently spread over the ice making recessed parts.

In at least an embodiment of the present invention, it is desirable that the cold air blowing outlet is located with respect to the ice tray on a side where the ice making recessed part is opened. According to this structure, the cold air blowing outlet is capable of facing water of the ice making recessed part. Therefore, the cold air can be blown to a surface of the water.

In at least an embodiment of the present invention, it is desirable that a dimension of the cold air blowing outlet in a direction perpendicular to the longitudinal direction of the ice tray and a depth direction of the ice making recessed part is smaller than that of the frame body. According to this structure, the cold air supply port can be disposed on an inner side of the frame body and thus cold air can be effectively supplied to the ice tray. Therefore, ice making efficiency can be enhanced.

In at least an embodiment of the present invention, it is desirable that the wall part is provided with a rib which divides the opening. According to this structure, a rectifying effect is obtained by the rib and thus a flow of the cold air can be stabilized. Further, a reinforcement effect is obtained by the rib and thus, even when the wall part is provided with the opening, strength of the wall part can be secured. In this case, it is preferable that the cold air duct is provided with an inclined flow passage part which is inclined with respect to a direction where an ice making recessed part provided in the ice tray is opened, the inclined flow passage part is provided with a cold air blowing outlet which faces the ice making recessed part, and the cold air blowing outlet is formed with a groove into which the rib is fitted. According to this structure, in addition to a reinforcement effect by the rib, the inclined flow passage part can be surely connected with the wall part and thus a stable flow of the cold air can be obtained. Specifically, it may be structured that the inclined flow passage part is provided with a lower inclined wall disposed in the opening and an upper inclined wall facing the lower inclined wall, the lower inclined wall and the upper inclined wall are inclined with respect to the direction where the ice making recessed part is opened, and each of the lower inclined wall and the upper inclined wall is formed with the groove into which the rib is fitted.

In at least an embodiment of the present invention, it is desirable that the wall part is provided with a holding hole which turnably holds a turning shaft protruded from the ice tray, the rib comprises a vertical rib which divides the opening in a width direction of the ice tray, a ring-shaped rib surrounding the holding hole, and a radial rib radially extended from the ring-shaped rib. According to this structure, a portion where the holding hole is provided is reinforced by the ring-shaped rib and the radial rib and, in addition, a portion where the opening is reinforced by the vertical rib. Therefore, the strength of the wall part can be secured. Further, a rectifying effect is obtained by the vertical rib and thus a flow of the cold air can be stabilized.

In at least an embodiment of the present invention, it is desirable that the cold air duct is provided with an engaging arm part which is protruded to the wall part, and the wall part is provided with an engaged part which is engageable with an engaging pawl provided at a tip end of the engaging arm part through elasticity of the engaging arm part. Since the snap-fit structure described above is provided, the cold air duct can be surely attached to the frame body by a simple operation.

In at least an embodiment of the present invention, it is desirable that the engaged part and the engaging pawl are provided at a position different from the opening. According to this structure, the snap-fit structure described above can be provided in a portion separated from the air passage of the cold air duct. Specifically, it may be structured that the inclined flow passage part is provided with a lower inclined wall disposed in the opening and an upper inclined wall facing the lower inclined wall, the lower inclined wall and the upper inclined wall are inclined with respect to the direction where the ice making recessed part is opened, and the engaging arm part or the engaged part which is provided in the cold air duct is provided on a lower side with respect to the lower inclined wall. Further, in a case that the engaging arm part is provided in the cold air duct, the engaging arm part is provided on a lower side with respect to the lower inclined wall.

In at least an embodiment of the present invention, it is desirable that the drive unit is structured to turn the ice tray by a predetermined angle from an ice making position, the frame body is provided with an abutting part which is abutted with a projection provided in the ice tray to apply a force in a twisting direction to the ice tray in a state that the ice tray has been turned by the predetermined angle, and each of the frame body and the cold air duct is formed with a relief part which avoids an interference with the ice tray in the state that the ice tray has been turned by the predetermined angle. According to this structure, an interference of the ice tray with the frame body and an interference of the cold air duct with the ice tray can be avoided.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION

An ice making machine 1 in accordance with at least an embodiment of the present invention will be described below with reference to the accompanying drawings. In the present specification, three axes of "X", "Y" and "Z" are directions perpendicular to each other. One side in the "X"-axis direction is indicated as "+X", the other side is indicated as "−X", one side in the "Y"-axis direction is indicated as "+Y", the other side is indicated as "−Y", one side in the "Z"-axis direction is indicated as "+Z", and the other side is indicated as "−Z". The "−Z" direction is a lower side in a vertical direction and the "+Z" direction is an upper side in the vertical direction.

(Ice Making Chamber)

Figure 1:
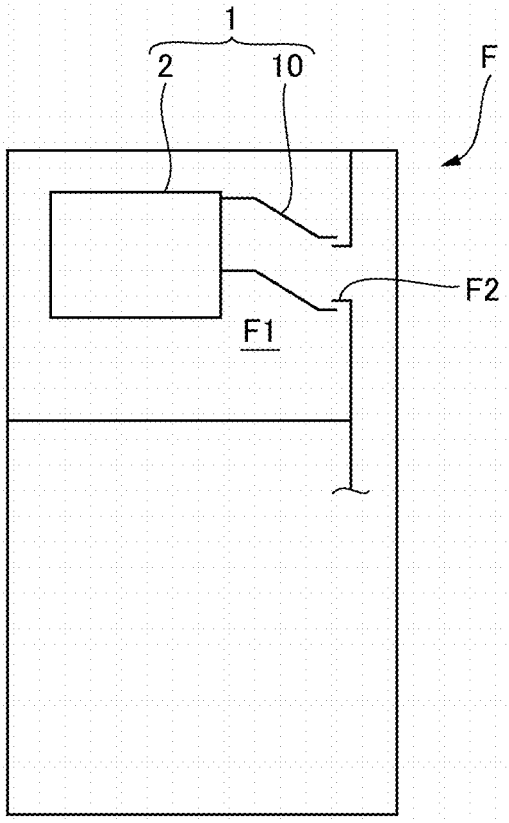
FIG. 1 is an explanatory view schematically showing a refrigerator which includes an ice making machine in accordance with an embodiment of the present invention.

FIG. 1 is an explanatory view schematically showing a refrigerator "F" which includes an ice making machine 1 to which at least an embodiment of the present invention is applied. An ice making machine 1 is arranged and used in an inside of an ice making chamber "F1" of the refrigerator "F". The refrigerator "F" includes a cold air supply part not shown for supplying cold air to the ice making chamber "F1". A cold air supply port "F2" is provided in an inside of the ice making chamber "F1", and the cold air supply port "F2" is connected with the cold air supply part. The ice making machine 1 includes an ice making machine main body 2 and a cold air duct 10. When the ice making machine 1 is arranged in the ice making chamber "F1", the ice making machine main body 2 and the cold air supply port "F2" are connected with each other through the cold air duct 10.

(Ice Making Machine)

Figure 2:
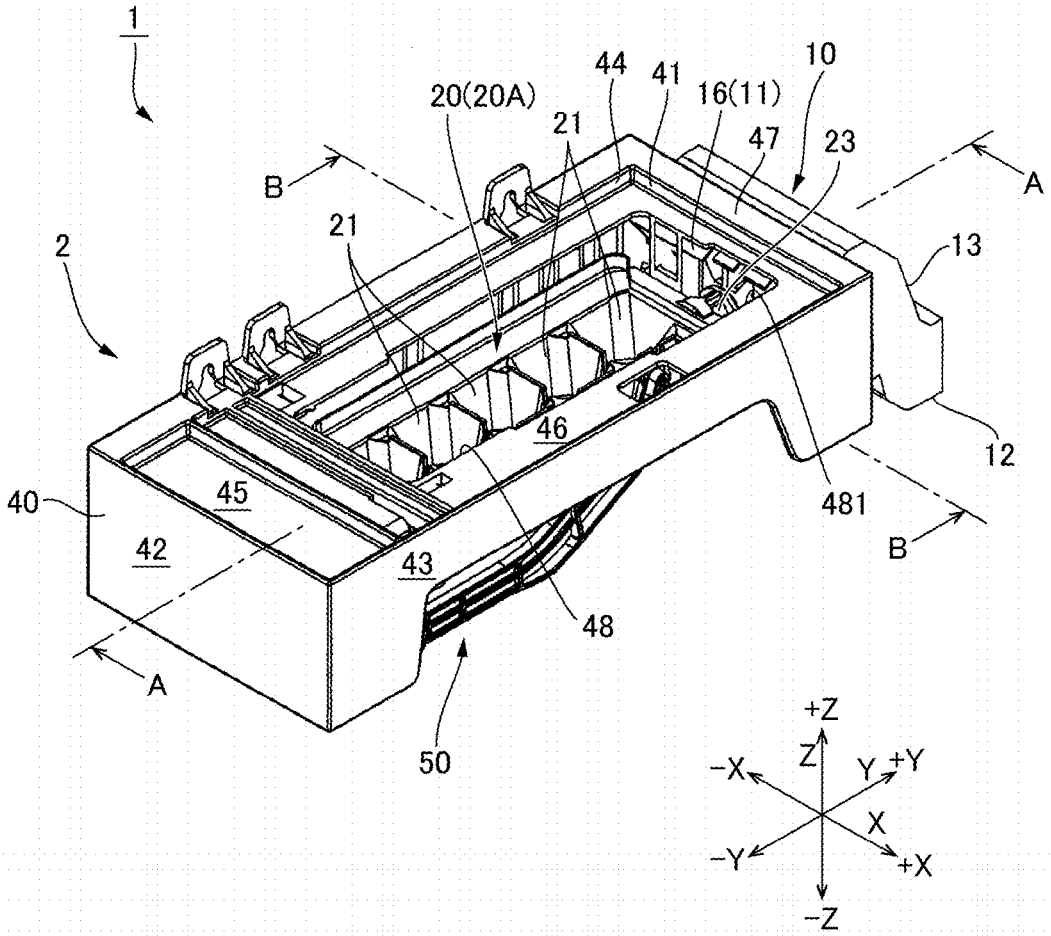
FIG. 2 is a perspective view showing an ice making machine in accordance with an embodiment of the present invention.
Figure 3:
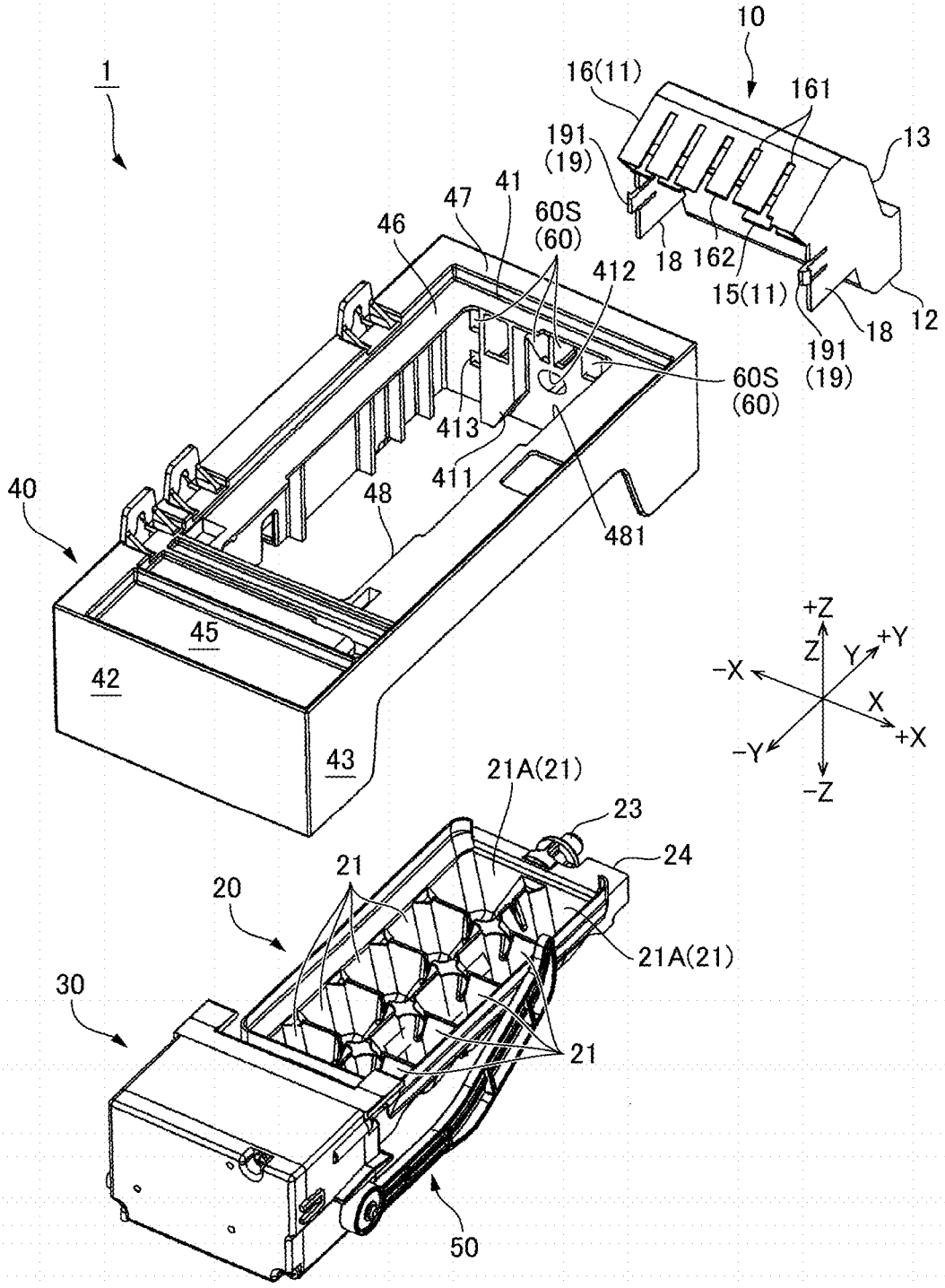
FIG. 3 is an exploded perspective view showing the ice making machine in FIG. 2.

FIG. 2 is a perspective view showing the ice making machine 1 to which at least an embodiment of the present invention is applied, and FIG. 3 is an exploded perspective view showing the ice making machine 1 in FIG. 2. The ice making machine main body 2 includes an ice tray 20, a drive unit 30 structured to turn the ice tray 20, a frame body 40 which supports the ice tray 20 and the drive unit 30, an ice storage container not shown which is disposed on a lower side ("−Z" direction) with respect to the ice tray 20, and an ice detection member 50 structured to detect an amount of ice in the ice storage container. A water supply mechanism not shown for supplying water to the ice tray 20 is disposed on an upper side ("+Z" direction side) of the ice making machine main body 2. The water supply mechanism drives a water-supply pump to supply water to the ice tray.

The ice tray 20 has a substantially rectangular planar shape and is provided with a plurality of ice making recessed parts 21. As shown in FIG. 2, the ice tray 20 is held by the frame body 40 at an ice making position 20A where the ice making recessed parts 21 face an upper side and, in this state, ice making is performed. A longitudinal direction of the ice tray 20 is coincided with the "Y"-axis direction. Further, when the ice tray 20 is located at the ice making position 20A, a short-side direction of the ice tray 20 is coincided with the "X"-axis direction. As shown in FIG. 3, a plurality of the ice making recessed parts 21 is arranged in the longitudinal direction of the ice tray 20, and the ice making recessed parts 21 are arranged in two rows in its short-side direction. The drive unit 30 is disposed on one side ("−Y" direction) in the longitudinal direction of the ice tray 20. Further, the ice detection member 50 is disposed on the "+X" direction side of the ice tray 20.

Figure 4:
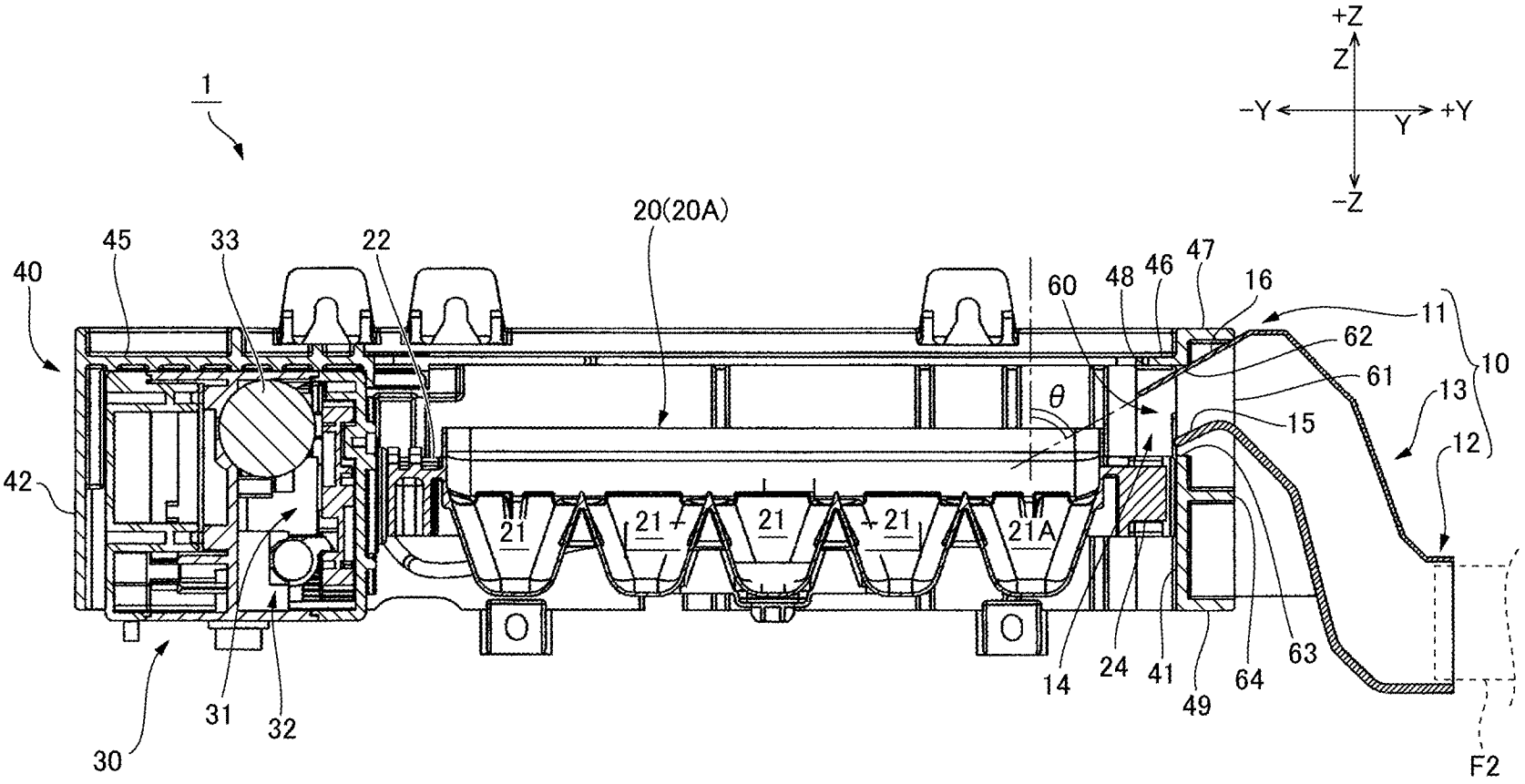
FIG. 4 is a cross-sectional view showing the ice making machine in FIG. 2 which is cut in its longitudinal direction.
Figure 5:
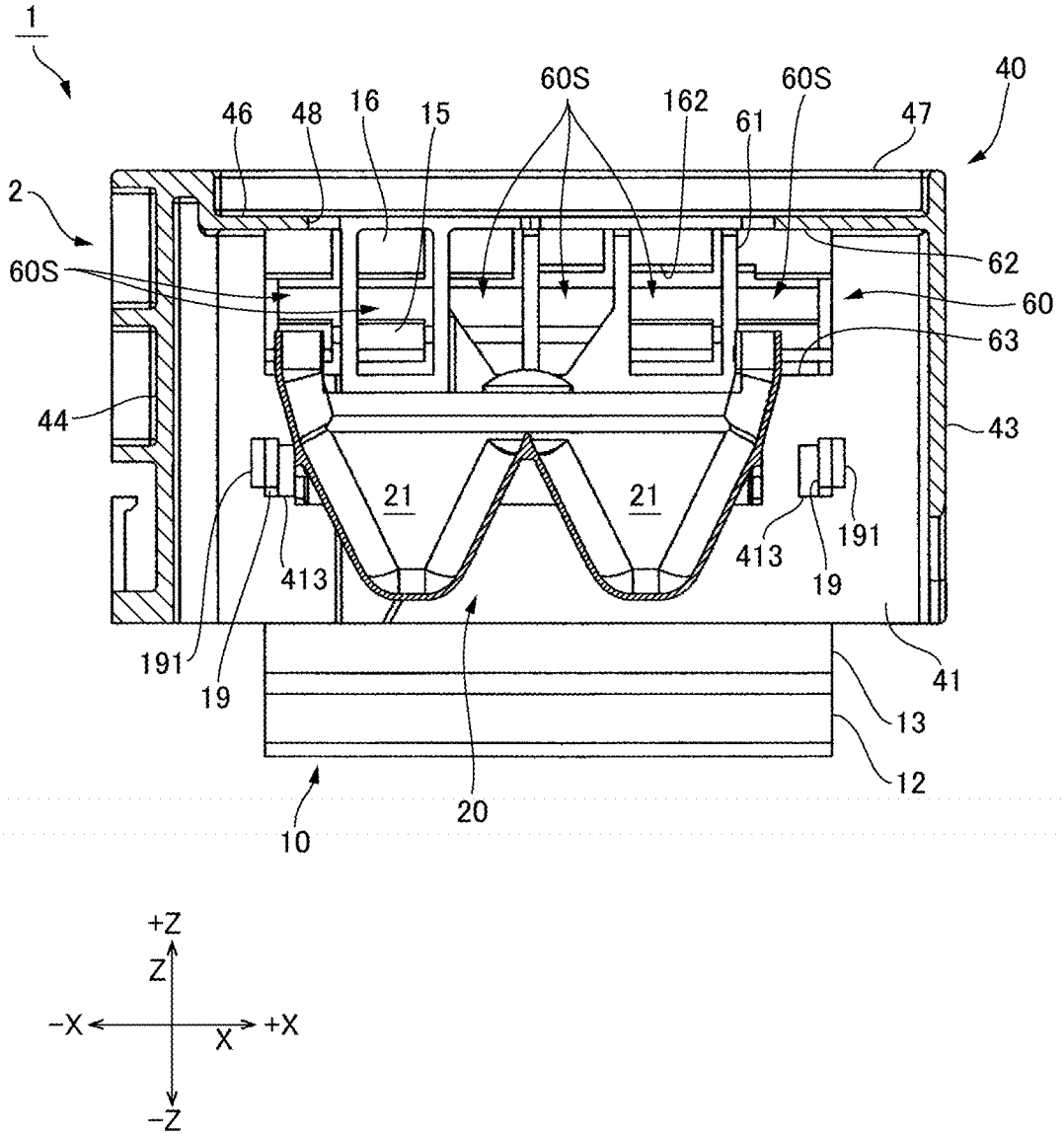
FIG. 5 is a cross-sectional view showing the ice making machine in FIG. 2 which is cut in its short-side direction.

FIG. 4 is a cross-sectional view showing the ice making machine 1 in FIG. 2 which is cut in its longitudinal direction ("A-A" cross-sectional view in FIG. 2). FIG. 5 is a cross-sectional view showing the ice making machine 1 in FIG. 2 which is cut in its short-side direction ("B-B" cross-sectional view in FIG. 2). As shown in FIG. 4, the drive unit 30 includes a first drive mechanism 31 structured to turn the ice tray 20, a second drive mechanism 32 structured to turn the ice detection member 50 to a lower side, and a motor 33 which is a drive source. The motor 33 drives the first drive mechanism 31 and the second drive mechanism 32. The motor 33 is a DC motor and is driven by an electric current supplied from the refrigerator "F" on which the ice making machine 1 is mounted. The ice tray 20 is provided with turning shafts 22 and 23 which are protruded from its one end and the other end in the longitudinal direction. The turning shaft 22 protruded to the drive unit 30 side ("−Y" direction side) is connected with an output shaft of the first drive mechanism 31 so as to be integrally turned together. The turning shaft 23 protruded on an opposite side to the drive unit 30 is turnably supported by the frame body 40.

In the drive unit 30, rotation of the motor 33 is transmitted to the ice tray 20 through the first drive mechanism 31 to turn the ice tray 20. When the ice tray 20 is turned by a predetermined angle (for example, 120 degrees) from the ice making position 20A, a projection 24 formed at an end part in the longitudinal direction of the ice tray 20 is abutted with an abutting part 411 (see FIG. 3) formed in the frame body 40. When the ice tray 20 is further turned, a force in a twisting direction is applied to the ice tray 20. As a result, the ice tray 20 is twisted and deformed and ice pieces in the ice making recessed parts 21 are separated and dropped to an ice storage container. After the motor 33 of the drive unit 30 turns the ice tray 20 by a predetermined angle (for example, 160 degrees) to separate the ice pieces, the motor 33 of the drive unit 30 turns the ice tray 20 in a reverse direction and the ice tray 20 is returned to the ice making position 20A.

(Frame Body)

Figure 6B:
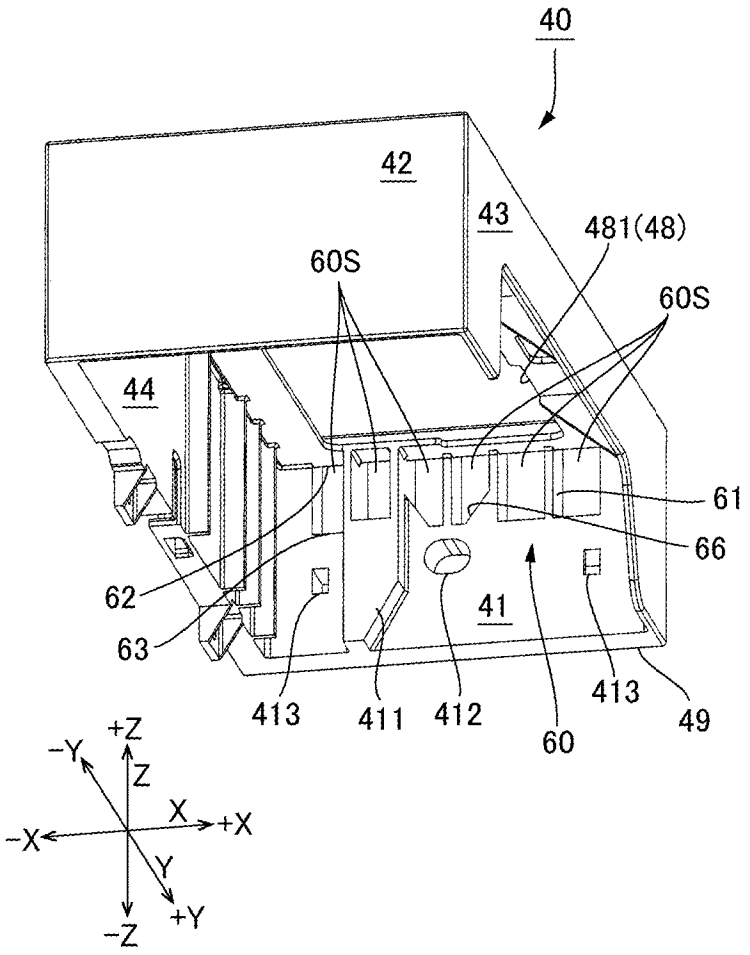
FIG. 6A and FIG. 6B are perspective views showing a frame body.
Figure 6A:
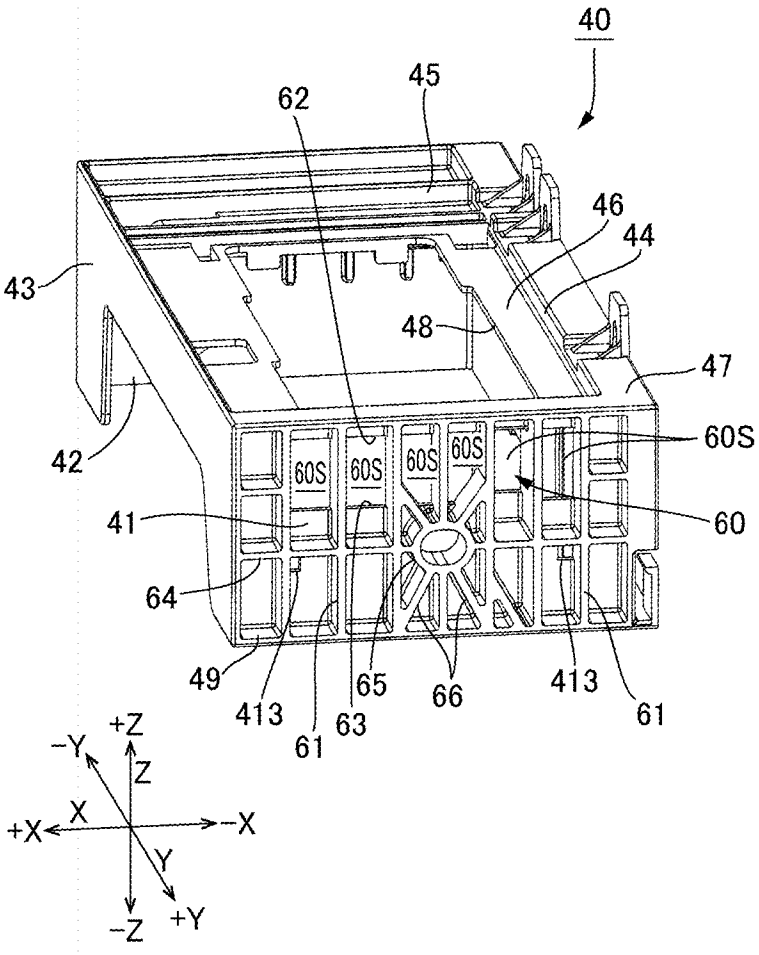

FIG. 6A and FIG. 6B are perspective views showing the frame body 40. FIG. 6A is a perspective view showing the frame body 40 which is viewed from an obliquely upper side on the "+Y" direction side, and FIG. 6B is a perspective view showing the frame body 40 which is viewed from an obliquely lower side on the "−Y" direction side. The frame body 40 has a substantially rectangular planar shape and surrounds an outer peripheral side of the ice tray 20 and the drive unit 30. The frame body 40 is provided with a wall part 41 located on the "+Y" direction side of the ice tray 20, a wall part 42 located on the "−Y" direction side of the drive unit 30, a wall part 43 located on the "+X" direction side of the ice tray 20 and the drive unit 30, and a wall part 44 located on the "−X" direction side of the ice tray 20 and the drive unit 30. The wall part 41 located on the "+Y" direction side is formed with a holding hole 412 which turnably holds the turning shaft 23. Further, an inner face of the wall part 41 is provided with an abutting part 411 which is structured to abut with the projection 24 of the ice tray 20 and restrict its turning. The drive unit 30 is fixed to an inner face of the wall part 42 located on the "−Y" direction side. Therefore, the wall part 41 located on the "+Y" direction side faces the drive unit 30. The ice tray 20 is disposed between the drive unit 30 and the wall part 41.

The frame body 40 is provided with an upper plate part 45 which covers an upper part of the drive unit 30, an inside frame part 46 projecting to an inner peripheral side at a position lowered by one stage from the upper plate part 45 and upper ends of the wall parts 41, 43 and 44, and an upper frame part 47 projecting to an outer peripheral side from the wall part 41 on the "+Y" direction side and from the upper end of the wall part 44 on the "−X" direction side. The inside frame part 46 is formed with a window part 48 in a substantially rectangular shape. A corner part of the window part 48 located between the "+X" direction and the "+Y" direction is formed with a frame body side relief part (recessed part) 481 which enlarges the opening shape by one stage to an outer side. The frame body side relief part 481 is provided for avoiding an interference between the ice tray 20 deformed by being applied with a force in the twisting direction and the inside frame part 46.

The wall part 41 is formed with an opening 60. The opening 60 is divided at a constant interval in its width direction ("X"-axis direction) by a plurality of vertical ribs 61 in a flat plate shape extended in the "Z"-axis direction and in the "Y"-axis direction (formed so as to be protruded in the upper and lower direction and in the longitudinal direction of the ice tray 20). In this embodiment, the opening 60 is divided into six portions by the vertical ribs 61 in a flat plate shape and the number of divided openings 60S partitioned by the vertical ribs 61 is six (6). However, the divided number of the opening 60 by the vertical ribs 61 is not limited to six (6). An outward shape of the opening 60 comprised of a plurality of the divided openings 60S is rectangular whose width direction ("X"-axis direction) is its longitudinal direction.

As shown in FIG. 5, an opening width of the opening 60 (width in the "X"-axis direction) is larger than a width in the "X"-axis direction of the ice tray 20 and, when viewed in the "Y"-axis direction, end edges on both sides in the width direction ("X"-axis direction) of the opening 60 are located on outer sides with respect to both ends in the width direction ("X"-axis direction) of the ice tray 20. An upper end face 62 and a lower end face 63 of the opening 60 face in the "Z"-axis direction and are extended in a straight shape in the "X"-axis direction. The upper end face 62 of the opening 60 is a lower face of the inside frame part 46. Further, the lower end face 63 of the opening 60 is located on an upper side ("+Z" direction side) with respect to the holding hole 412 by which the turning shaft 23 of the ice tray 20 is held. In other words, the opening 60 is formed on an upper side ("+Z" direction side) with respect to a height where the ice tray 20 is disposed.

The wall part 41 is formed with a rectangular engaging hole 413 at two positions on the "+X" direction side and the "−X" direction side with respect to the holding hole 412. The engaging holes 413 are disposed on an outer peripheral side of the opening 60. Specifically, the engaging holes 413 are provided on lower sides ("−Z" direction side) of both end positions in the width direction ("X"-axis direction) of the opening 60 and at positions separated from the opening 60.

As shown in FIG. 6A, the vertical ribs 61 are provided on an outer side face of the wall part 41. The upper ends of the vertical ribs 61 are connected with the upper frame part 47. Further, a lower end of the wall part 41 is formed with a lower frame part 49 which faces the upper frame part 47 in the "Z"-axis direction, and lower ends of the vertical ribs 61 are connected with the lower frame part 49. The wall part 41 is formed with eight vertical ribs 61 which are extended from the upper frame part 47 to the lower frame part 49. The vertical rib 61 located on the most "+X" direction side of the eight vertical ribs 61 is disposed at an end in the "+X" direction of the wall part 41 and is located on the same face as the wall part 43. Further, the second vertical rib 61 and the eighth vertical rib 61 from the "+X" direction side are disposed along an edge on the "+X" direction side of the opening 60 and along an edge on the "−X" direction side. Therefore, a width in the "X"-axis direction of the opening 60 is smaller than a width in the "X"-axis direction of the frame body 40. Further, the third through the seventh vertical ribs 61 from the "+X" direction side divide the opening 60.

An outer side face of the wall part 41 is formed with a lateral rib 64 which is perpendicular to the vertical ribs 61. The lateral rib 64 is horizontally provided at a position of the holding hole 412 by which the turning shaft 23 of the ice tray 20 is held. Therefore, the opening 60 is formed between an upper position with respect to the lateral rib 64 and the frame part 47. Further, the outer side face of the wall part 41 is formed with a ring-shaped rib 65 surrounding the holding hole 412 by which the turning shaft 23 of the ice tray 20 is held, and radial ribs 66 which are radially extended from the ring-shaped rib 65 toward an outer side in a radial direction. As shown in FIG. 6A, two center divided openings 60S of the six divided openings 60S are sectioned by the radial ribs 66.

(Cold Air Duct)

Figure 7B:
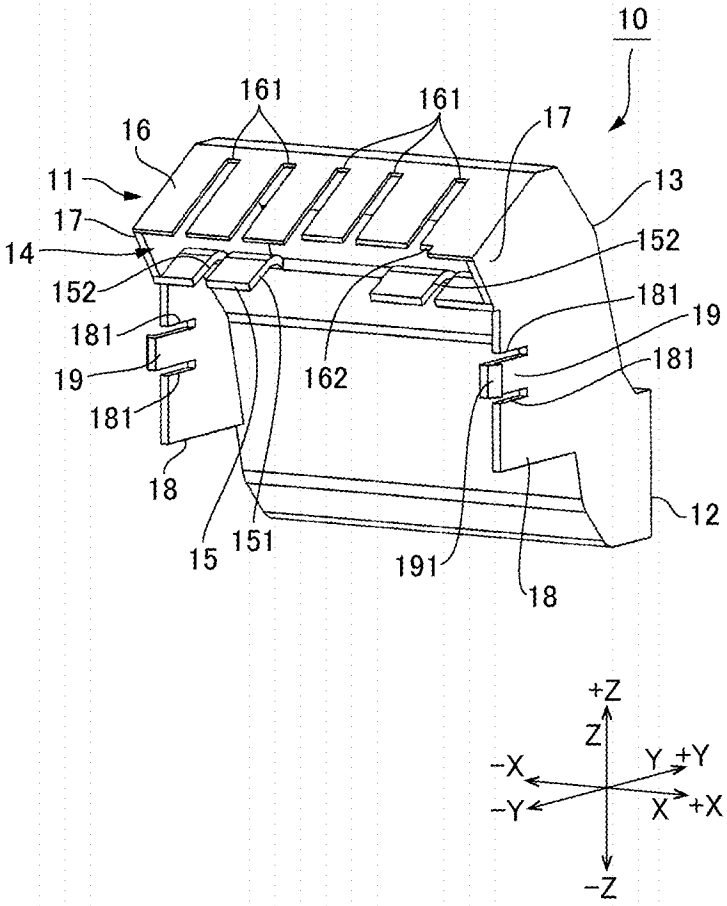
FIG. 7A and FIG. 7B are perspective views showing a cold air duct.
Figure 7A:
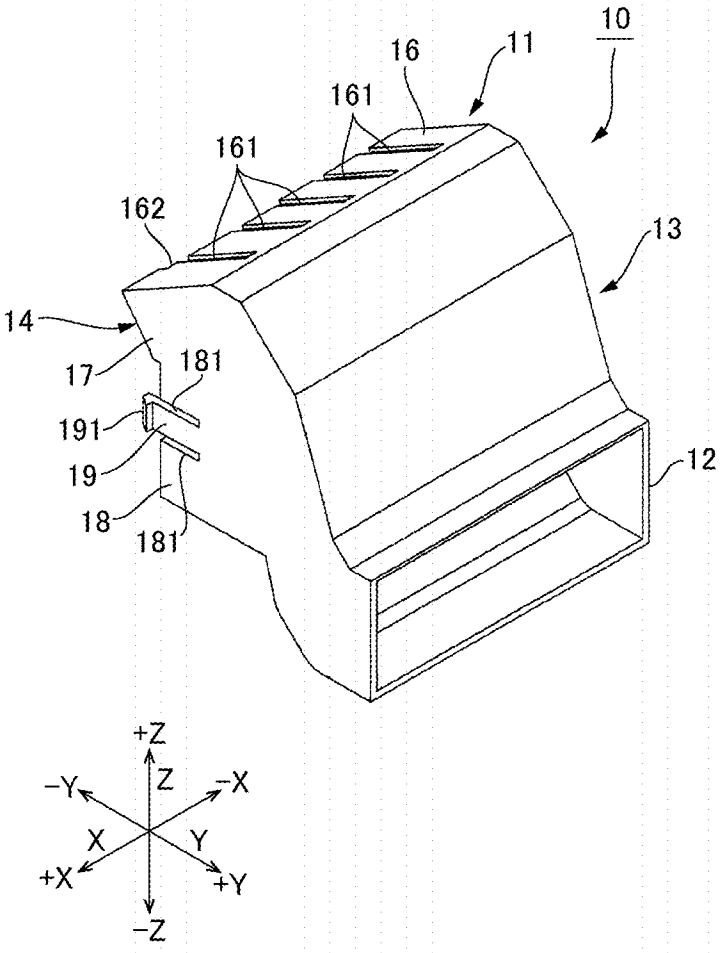

FIG. 7A and FIG. 7B are perspective views showing a cold air duct 10 which is capable of being attached and detached to and from the ice making machine main body 2, specifically, attached and detached to and from the frame body 40 which supports the ice tray 20 and the drive unit 30. FIG. 7A is a perspective view showing the cold air duct 10 which is viewed from an obliquely upper side on the "+Y" direction side, and FIG. 7B is a perspective view showing the cold air duct 10 which is viewed in a direction between the "−Y" direction and the "+X" direction. Next, a structure of the cold air duct 10 will be described below with reference to FIG. 4, FIG. 7A and FIG. 7B and the like. As shown in FIG. 4, the cold air duct 10 is provided with an inclined flow passage part 11 which is connected with the opening 60 provided in the wall part 41, an attaching part 12 which is to be connected with the cold air supply port "F2" of the ice making chamber "F1", and a connecting flow passage part 13 which connects the inclined channel part 11 with the attaching part 12. The connecting flow passage part 13 is connected with an upper end of the inclined flow passage part 11 and is inclined in a reverse direction with respect to an inclined direction of the inclined flow passage part 11 as a whole. Therefore, cold air which is sent from the cold air supply port "F2" into the cold air duct 10 is obliquely flowed upward along the connecting flow passage part 13 and is sent to a height which is higher than a height of the opening 60. Then, the cold air is obliquely blown down along the inclined flow passage part 11 to be sent into an inside of the frame body 40 through the opening 60 and is blown down to the ice tray 20.

The inclined flow passage part 11 is inclined with respect to the ice tray 20. The ice making recessed parts 21A provided in the ice tray 20 which are provided at the closest position to the wall part 41 are located on an extended line of the inclined flow passage part 11. The inclined flow passage part 11 is inclined in a downward direction from an obliquely upper side toward the ice making recessed parts 21A located on the most front side viewed from the wall part 41. As shown in FIG. 4, when the ice tray 20 is located at the ice making position 20A, the ice making recessed parts 21A are faced and opened toward an upper side ("+Z" direction side). An inclination angle "0" of the inclined flow passage part 11 is set to be a predetermined angle of less than 90 degrees with respect to a direction ("+Z" direction) that the ice making recessed parts 21A are opened. A cold air blowing outlet 14 provided at a tip end (lower end) of the inclined flow passage part 11 is faced to the ice making recessed parts 21A located at the closest position to the wall part 41 and thus cold air flowing through the inclined flow passage part 11 is blown to the ice making recessed parts 21A located at the closest position to the wall part 41.

The inclined flow passage part 11 is provided with a lower inclined wall 15 which structures an edge on the lower side ("−Z" direction side) of the cold air blowing outlet 14, an upper inclined wall 16 which structures an edge on an upper side ("+Z" direction side) of the cold air blowing outlet 14, and a pair of right and left side walls 17 (see FIG. 7A and FIG. 7B) which connect the lower inclined wall 15 with the upper inclined wall 16. Therefore, the inclined flow passage part 11 is formed in a substantially rectangular tube shape. The lower inclined wall 15 and the upper inclined wall 16 are flat faces which are inclined in the direction inclined by the angle "0", and the lower inclined wall 15 and the upper inclined wall 16 are faced each other. The side walls 17 structure side faces on both sides in the "X"-axis direction of the inclined flow passage part 11.

A tip end of the lower inclined wall 15 is directed in a direction to the ice making recessed parts 21A which are located at the closest position to the wall part 41. Further, the cold air blowing outlet 14 which is opened between the lower inclined wall 15 and the upper inclined wall 16 is located on an upper side with respect to the ice tray 20, in other words, located on a side where the ice making recessed parts 21 are opened with respect to the ice tray 20, and the cold air blowing outlet 14 are faced to the closest ice making recessed parts 21A to the wall part 41. Therefore, cold air sent from the cold air blowing outlet 14 is blown to the closest ice making recessed parts 21A to the wall part 41. Therefore, when water has been supplied to the ice making recessed parts 21A, the cold air is blown to the surface of the water. The cold air blown to the ice making recessed parts 21A is flowed toward the drive unit 30 along the ice tray 20. Accordingly, a flow of the cold air going from the wall part 41 side of the ice tray 20 toward the drive unit 30 side is formed and thus the cold air can be efficiently flowed to the entire ice making recessed parts 21.

As shown in FIG. 7B, a center in the width direction of the lower inclined wall 15 is formed with a cut-out part 151 which is formed by cutting out a region corresponding to two center divided openings 60S (in other words, the divided openings 60S provided with the radial ribs 66). The radial ribs 66 and three vertical ribs 61 are disposed in the cut-out part 151. Further, one groove part 152 which is formed by cutting out at a position corresponding to the vertical rib 61 provided in the opening 60 is formed on both sides with respect to the cut-out part 151. On the other hand, the upper inclined wall 16 is formed with five groove parts 161 which are formed by cutting out at positions corresponding to the vertical ribs 61 provided in the opening 60. Further, a tip end of the upper inclined wall 16 is formed with a duct side relief part (recessed part) 162 in a predetermined region in the width direction. The duct side relief part 162 is a cut-out part which is formed by cutting out a tip end of the upper inclined wall 16. The duct side relief part 162 is, similarly to the frame body side relief part (recessed part) 481 formed in the inside frame part 46 of the frame body 40, formed in a shape so as to avoid an interference between the ice tray 20 applied and deformed by a force in the twisting direction and the cold air duct 10.

When the inclined flow passage part 11 is to be connected with the opening 60 of the frame body 40, each of the vertical ribs 61 is fitted to each of the groove parts 161 formed in the upper inclined wall 16 and to each of the groove parts 152 formed in the lower inclined wall 15. In this case, a tip end of the vertical rib 61 is entered to a groove bottom of the groove part 161 and is fitted to the groove part 161 between both sides in the "X"-axis direction of the inclined flow passage part 11. As a result, the upper inclined wall 16 is inserted into an inner side of the frame body 40 through a lower side of the upper end face 62 of the opening 60. Further, similarly, the tip end of the vertical rib 61 is entered to a groove bottom of the groove part 152 and is fitted to the groove part 152 and thus, the tip end of the lower inclined wall 15 is entered into an inner side of the frame body 40 through an upper side of the lower end face 63 of the opening 60. Therefore, the cold air blowing outlet 14 provided at the tip end (lower end) of the inclined flow passage part 11 is structured of a plurality of the cold air blowing outlets 14 which are formed in a divided state by the vertical ribs 61, the upper inclined wall 16 and the lower inclined wall 15. Further, the tip end of the upper inclined wall 16 and the tip end of the lower inclined wall 15 are entered into an inner side of the frame body 40 and thus, the cold air blowing outlet 14 can be brought close to the vicinity of the ice making recessed parts 21 provided in the ice tray 20.

As shown in FIG. 7B, the side wall 17 of the inclined flow passage part 11 is connected with a side wall of the connecting flow passage part 13 so as to form the same flat face. Further, subsidiary side walls 18 are formed on a side of the frame body 40 in the connecting flow passage part 13 so as to form the same flat face as the side wall 17 of the inclined flow passage part 11 and the side wall of the connecting flow passage part 13. The subsidiary side wall 18 is formed with two groove parts 181 which are extended in a straight line shape to the "+Y" direction from an end face on the side of the frame body 40 toward the connecting flow passage part 13. An engaging arm part 19 protruding to the frame body 40 side is formed between the two groove parts 181. One piece of the subsidiary side wall 18 is formed on both sides in the width direction ("X"-axis direction) of the connecting flow passage part 13. Therefore, the engaging arm part 19 is provided at two positions separated from each other in the width direction ("X"-axis direction). Further, the engaging arm part 19 is provided at a position on a lower side with respect to the tip end of the lower inclined wall 15. The wall part 41 of the frame body 40 is formed with an engaging hole 413 at two positions corresponding to the two engaging arm parts 19.

When the inclined flow passage part 11 is to be connected with the opening 60, the side walls 17 of the inclined flow passage part 11 are inserted into an inner side of the frame body 40 along the vertical ribs 61 located at both ends in the width direction ("X"-axis direction) of the opening 60. As a result, the lower inclined wall 15 and the upper inclined wall 16 of the inclined flow passage part 11 are inserted into the inner side of the opening 60 as described above and, in addition, the side walls 17 are contacted with both inner side faces of the vertical ribs 61 in the width direction ("X"-axis direction) of the opening 60. In other words, the cold air duct 10 is structured so that the inclined flow passage part 11 is inserted into the inner side of the opening 60. Further, in this case, the vertical rib 61 is entered into the groove part 161 formed in the upper inclined wall 16, and the vertical rib 61 is entered into the groove part 152 formed in the lower inclined wall 15 and, in addition, the vertical ribs 61 and the radial ribs 66 are entered into the cut-out part 151 and thus, cold air is blown out from the inclined flow passage part 11 in a state that the cold air blowing outlet 14 is divided as the divided openings 60S. Further, each of the divided openings 60S is partitioned by the vertical ribs 61 which are protruded in the "Y"-axis direction (longitudinal direction of the ice tray 20) and thus, the cold air passing through the divided openings 60S is guided in the longitudinal direction of the ice tray 20 by the vertical ribs 61.

Further, when the inclined flow passage part 11 is to be connected with the opening 60, the tip end of the engaging arm part 19 is inserted into the engaging hole 413. The tip end of the engaging arm part 19 is formed with an engaging pawl 191 which is engageable with an edge of the engaging hole 413. When the cold air duct 10 is to be attached to the frame body 40, the two engaging arm parts 19 are elastically deformed in a mutually approaching direction and the engaging pawls 191 are passed through the engaging holes 413. As a result, the engaging pawls 191 are engaged with edges of the engaging holes 413 by elastic return forces of the engaging arm parts 19. In this manner, the cold air duct 10 is attached to the frame body 40 by a snap-fit structure. In accordance with an embodiment of the present invention, an engaged part with which the engaging pawl 191 is engaged may be formed in a shape provided with an edge part structured to engage with the engaging pawl 191. For example, the engaged part may be a rib. Since the cold air duct 10 is attached to the frame body 40 by a snap-fit structure, when the engaging pawl 191 is disengaged from the engaging hole 413, the cold air duct 10 can be detached from the frame body 40.

A dimension in the "X"-axis direction of the inclined flow passage part 11 is substantially constant, and an opening width (dimension in the "X"-axis direction) of the cold air blowing outlet 14 is smaller than a width in the "X"-axis direction of the frame body 40. In this embodiment, the "X"-axis direction is perpendicular to the longitudinal direction of the ice tray 20 ("Y"-axis direction) and, in addition, the "X"-axis direction is a direction perpendicular to a depth direction of the ice making recessed part 21 ("Z"-axis direction). The cold air blowing outlet 14 having the above-mentioned opening width can be disposed on an inner side of the frame body 40 and thus the cold air blowing outlet 14 can be disposed in the vicinity of the ice tray 20. Therefore, cold air can be effectively supplied to the ice tray 20. Further, the opening width (dimension in the "X"-axis direction) of the cold air blowing outlet 14 is larger than the width in the "X"-axis direction of the ice tray 20 and thus the entire ice tray 20 in the width direction can be blown with cold air.

(Principal Operations and Effects in this Embodiment)

As described above, the ice making machine 1 in accordance with at least an embodiment of the present invention includes the ice making machine main body 2 and the cold air duct 10, and the opening 60 formed in the frame body 40 of the ice making machine main body 2 and the cold air supply port "F2" are connected with each other through the cold air duct 10. Therefore, according to the ice making machine 1, a change and the like of arrangement and/or a shape of the cold air supply port "F2" can be easily coped. Further, the cold air supply port "F2" and the opening 60 are connected with each other through the cold air duct 10 and thus cold air can be effectively supplied to an inner side of the frame body 40. Further, the cold air duct 10 is connected by utilizing the wall part 41 located on an opposite side to the drive unit 30 for turning the ice tray 20 and thus cold air can be supplied to the vicinity of the ice tray 20 in a simple structure. Therefore, ice making efficiency can be enhanced. Further, cold air is supplied from an end part in the longitudinal direction of the ice tray 20 and thus the cold air can be effectively spread over the ice tray 20.

The cold air duct 10 in this embodiment is provided with the inclined flow passage part 11 which is inclined with respect to a direction ("+Z" direction) that the ice making recessed parts 21 provided in the ice tray 20 are opened, and the inclined flow passage part 11 is provided with the cold air blowing outlet 14 which faces the ice making recessed parts 21. Specifically, the inclined flow passage part 11 is provided with the lower inclined wall 15 which is disposed along the lower end face 63 (in other words, the face on the ice tray 20 side) of the opening 60 provided in the wall part 41 and the upper inclined wall 16 facing the lower inclined wall 15, and the upper inclined wall 16 and the lower inclined wall 15 are inclined with respect to the direction that the ice making recessed parts 21 are opened. According to this structure, cold air is blown down between the upper inclined wall 16 and the lower inclined wall 15 and thus the cold air is blown obliquely downward from the cold air blowing outlet 14 toward the ice making recessed parts 21. Therefore, cold air can be blown obliquely downward to the ice making recessed parts 21 and thus ice making efficiency can be enhanced.

In this embodiment, the tip end of the lower inclined wall 15 is directed in a direction toward the ice making recessed parts 21A which are located at the closest position to the wall part 41. Further, the cold air blowing outlet 14 of the inclined flow passage part 11 faces in a direction of the ice making recessed parts 21A located at the closest position to the wall part 41. Therefore, cold air can be blown to the ice making recessed parts 21A located at the most front side when viewed from the wall part 41 side and thus the cold air can be flowed from the wall part side of the ice tray toward the drive unit side. Accordingly, the cold air can be efficiently spread over the ice making recessed parts 21. In accordance with an embodiment of the present invention, the tip end of the lower inclined wall 15 may be directed in a direction between the ice making recessed parts 21A located at the closest position to the wall part 41 and the wall part 41. Even in this arrangement, the cold air can be blown to the ice making recessed parts 21A located at the closest position to the wall part 41.

The cold air duct 10 in this embodiment is attached to the ice making machine main body 2 so that the cold air blowing outlet 14 is located on a side where the ice making recessed parts 21 are opened with respect to the ice tray 20. As a result, the cold air blowing outlet 14 is disposed at a position facing water in the ice making recessed parts 21. Therefore, cold air can be blown to the water surface and the ice making efficiency can be enhanced.

The cold air duct 10 in this embodiment is provided with the cold air blowing outlet 14 whose opening width (width in the "X"-axis direction) is smaller than the width in the "X"-axis direction of the frame body 40. Therefore, the cold air blowing outlet 14 can be disposed on an inner side of the frame body 40, and the cold air blowing outlet 14 can be disposed in the vicinity of the ice tray 20. Accordingly, cold air can be effectively supplied to the ice tray 20 and ice making efficiency can be enhanced. Further, the opening width (width in the "X"-axis direction) of the cold air blowing outlet 14 is larger than the width (width in the "X"-axis direction) of the ice tray 20. Therefore, cold air can be blown to the entire ice tray 20 in the width direction.

In this embodiment, the vertical ribs 61 are formed in the opening 60 to which the cold air duct 10 is attached. The vertical rib 61 is a flat plate-shaped protruding rib which is formed so as to protrude in the upper and lower direction and in the longitudinal direction of the ice tray 20. Therefore, a rectifying effect is obtained by the vertical ribs 61 and thus a flow of the cold air can be stabilized. Further, a reinforcement effect is obtained by the vertical ribs 61 and thus, even when the wall part 41 is provided with the opening 60, strength of the wall part 41 can be secured. In accordance with an embodiment of the present invention, a direction of the rib which reinforces the opening 60 is not limited to a vertical direction ("Z"-axis direction). For example, the direction of the rib may be a lateral direction ("X"-axis direction) or a direction between the vertical direction and the lateral direction.

In this embodiment, the wall part 41 is provided with the holding hole 412 by which the turning shaft 23 of the ice tray 20 is held, and the wall part 41 is formed with the ring-shaped rib 65 surrounding the holding hole 412 and the radial ribs 66 which are radially extended from the ring-shaped rib 65 toward an outer side in the radial direction. Therefore, a portion where the opening 60 is provided is reinforced by the vertical ribs 61 and, in addition, a portion where the holding hole 412 is provided is reinforced by the ring-shaped rib 65 and the radial ribs 66. Accordingly, the strength of the wall part 41 can be secured sufficiently.

In this embodiment, the cold air duct 10 is attached to the frame body 40 by a snap-fit structure. Specifically, the cold air duct 10 is provided with the engaging arm parts 19 protruding toward the wall part 41, and the wall part 41 is formed with the engaged parts (edges of the engaging holes 413) which are capable of being engaged with the engaging pawls 191 through elasticity of the engaging arm parts 19. Therefore, the cold air duct 10 can be surely attached to the frame body 40 with a simple operation. In accordance with an embodiment of the present invention, it may be structured that an engaging arm part provided with an engaging pawl is provided in the wall part 41 and an engaged part is provided in the cold air duct 10.

In this embodiment, the engaging hole 413 is provided at two positions different from the opening 60, and the cold air duct 10 and the frame body 40 are connected with each other at two positions separated from each other by a snap-fit structure. Therefore, the cold air duct 10 can be surely attached to the opening 60 of the frame body 40. Further, the engaging arm part 19 is provided at a position on a lower side with respect to the tip end of the lower inclined wall 15 and thus, the snap-fit structure can be provided at a position where an air passage of cold air is not affected.

In this embodiment, in a state that the ice tray 20 is turned by a predetermined angle from the ice making position 20A, the projection 24 provided in the ice tray 20 and the abutting part 411 provided in the frame body 40 are abutted with each other and a force in a twisting direction is applied to the ice tray 20. Therefore, the inside frame part 46 of the frame body 40 is formed with the frame body side relief part (recessed part) 481 for avoiding an interference with the ice tray 20 which has been twisted and deformed. Further, the upper inclined wall 16 of the cold air duct 10 is formed with the duct side relief part (recessed part) 162 which is formed by cutting out a position corresponding to the frame body side relief part 481 of the frame body 40. Therefore, an interference between the cold air duct 10 and the ice tray 20 can be prevented.

Modified Embodiments

In the embodiment described above, the cold air blowing outlet 14 of the inclined flow passage part 11 faces a direction of the ice making recessed parts 21A located at the closest position to the wall part 41, or faces a direction between the ice making recessed parts 21A and the wall part 41. However, the cold air blowing outlet 14 may face a direction of the ice making recessed parts 21 other than the ice making recessed parts 21A located at the closest position to the wall part 41. Even in this structure, a flow of cold air toward the ice making recessed parts 21 can be obtained. Therefore, cold air can be effectively supplied to the ice making recessed parts 21 of the ice tray 20 and thus the ice making efficiency can be enhanced.

In the embodiment described above, the cold air supply port "F2" is located on a lower side ("−Z" direction side) with respect to the opening 60 provided in the wall part 41 and thus, the connecting flow passage part 13 of the cold air duct 10 is inclined in a reverse direction to the inclined direction of the inclined flow passage part 11. However, a direction of the connecting flow passage part 13 may be appropriately changed depending on a position of the cold air supply port "F2". In this case, the position of the opening 60 and the inclined direction of the inclined flow passage part 11 are not changed and a shape of the connecting flow passage part 13 is changed. For example, in a case that the cold air supply port "F2" is located at the same height as the opening 60, a cold air duct 10 provided with a connecting flow passage part 13 which is extended in a substantially horizontal direction may be used. Further, in a case that the cold air supply port "F2" is located on an upper side ("+Z" direction side) with respect to the opening 60, a cold air duct 10 may be used which is provided with a connecting flow passage part 13 inclined downward from the cold air supply port "F2" to the upper end of the inclined flow passage part 11. Further, in a case that the cold air supply port "F2" is provided at a position displaced on the "+X" direction side or the "−X" direction side with respect to the opening 60, a cold air duct 10 may be used which is provided with a connecting flow passage part 13 facing a direction between the "Y"-axis direction and the "X"-axis direction. According to these structures, the cold air supply port "F2" and the upper end of the inclined flow passage part 11 can be connected with each other and thus, similarly to the embodiment described above, cold air can be effectively supplied to the ice making recessed parts 21 of the ice tray 20.

In the embodiment described above, the opening widths (width in the "X"-axis direction) of the opening 60 and the cold air blowing outlet 14 are larger than the width in the "X"-axis direction of the ice tray 20. However, the opening widths (width in the "X"-axis direction) of the opening 60 and the cold air blowing outlet 14 may be smaller than the width in the "X"-axis direction of the ice tray 20. Even when the opening width of the cold air blowing outlet 14 is narrower than the width of the ice tray 20, cold air is spread to both sides in the width direction ("X"-axis direction) and thus the cold air can be supplied to a portion displaced from a front face of the cold air blowing outlet 14.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An ice making machine which is disposed in an ice making chamber provided with a cold air supply port to which cold air is supplied, the cold air being used to freeze water supplied to an ice tray to make ice, the ice making machine comprising:

the ice tray comprising a plurality of the ice making recessed parts which are disposed upward and arranged in a longitudinal direction of the ice tray;

a drive unit which is provided on a first end side in the longitudinal direction of the ice tray, the drive unit comprising a motor and being structured to turn the ice tray;

a frame body which supports the ice tray and the drive unit; and a cold air duct which connects an opening formed in the frame body with the cold air supply port;

wherein the frame body further comprises a wall part provided so as to face the drive unit on a second end side in the longitudinal direction of the ice tray which is an opposite side to the first end side;

the wall part comprises the opening through which the cold air is sent to the ice tray and a rib which divides the opening, the cold air duct comprises an inclined flow passage part which is connected with the opening and is inclined so as to send the cold air to the ice tray through the opening, the inclined flow passage part comprising a cold air blowing outlet which faces the ice making recessed part, the inclined flow passage pan comprises a lower inclined wall disposed in the opening and an upper inclined wall facing the lower inclined wall, the lower inclined wall and the upper inclined wall are inclined with respect to a direction where the ice making recessed part is opened, and each of the lower inclined wall and the upper inclined wall is formed with a groove into which the rib is fitted.

2. The ice making machine according to claim 1, wherein a tip end of the lower inclined wall is directed in a direction of the ice making recessed part which is located on the second end side in the longitudinal direction of the ice tray and is closest to the wall part, or in a direction between the ice making recessed part which is located on the second end side in the longitudinal direction of the ice tray and is closest to the wall part and the wall part.

3. The ice making machine according to claim 1, wherein the cold air blowing outlet faces the ice making recessed part which is located on the second end side in the longitudinal direction of the ice tray and is closest to the wall part.

4. The ice making machine according to claim 1, wherein the cold air blowing outlet is located with respect to the ice tray on a side where the ice making recessed part is opened.

5. The ice making machine according to claim 1, wherein a dimension of the cold air blowing outlet in a direction perpendicular to the longitudinal direction of the ice tray and a depth direction of the ice making recessed part is smaller than that of the frame body.

6. The ice making machine according to claim 1, wherein the wall part comprises a holding hole which turnably holds a turning shaft protruded from the ice tray, and the rib comprises a vertical rib which divides the opening in a width direction of the ice tray, a ring-shaped rib surrounding the holding hole, and a radial rib radially extended from the ring-shaped rib.

7. The ice making machine according to claim 6, wherein the vertical rib is fitted to the grooves of the lower inclined wall and the upper inclined wall.

8. An ice making machine which is disposed in an ice making chamber provided with a cold air supply port to which cold air is supplied, the cold air being used to freeze water supplied to an ice tray to make ice, the ice making machine comprising:

the ice tray comprising a plurality of the ice making recessed pans which are disposed upward and arranged in a longitudinal direction of the ice tray;

a drive unit which is provided on a first end side in the longitudinal direction of the ice tray, the drive unit comprising a motor and being structured to turn the ice tray;

a frame body which supports the ice tray and the drive unit; and a cold air duct which connects an opening formed in the frame body with the cold air supply port, wherein the frame body further comprises a wall part which is provided in the frame body at a second end side in the longitudinal direction of the ice tray so as to face the drive unit on an opposite side to the first end side;

the wall part comprises the opening through which the cold air is sent to the ice tray, one of the cold air duct and the wall part comprises an engaging arm part which is protruded to an other of the cold air duct and the wall part, and the other of the cold air duct and the wall part comprises an engaged part which is engageable with an engaging pawl provided at a tip end of the engaging arm part through elasticity of the engaging arm part.

9. The ice making machine according to claim 8, wherein the engaging arm part is provided in the cold air duct, and the engaged part is provided at a position which is different from the opening.

10. The ice making machine according to claim 8, wherein the cold air duct comprises an inclined flow passage part which is inclined with respect to a direction where an ice making recessed part provided in the ice tray is opened, and the inclined flow passage part comprises a cold air blowing outlet which faces the ice making recessed part.

11. The ice making machine according to claim 10, wherein the inclined flow passage part comprises a lower inclined wall disposed in the opening and an upper inclined wall facing the lower inclined wall, the lower inclined wall and the upper inclined wall are inclined with respect to the direction where the ice making recessed part is opened, and the engaging arm part or the engaged part which is provided in the cold air duct is provided on a lower side with respect to the lower inclined wall.

12. The ice making machine according to claim 11, wherein the engaging arm part is provided in the cold air duct, and the engaging arm part is provided on a lower side with respect to the lower inclined wall.

13. An ice making machine which is disposed in an ice making chamber provided with a cold air supply port to which cold air is supplied, the cold air being used to freeze water supplied to an ice tray to make ice, the ice making machine comprising:

the ice tray comprising a plurality of the ice making recessed pans which are disposed upward and arranged in a longitudinal direction of the ice tray;

a drive unit which is provided on a first end side in the longitudinal direction of the ice tray, the drive unit comprising a motor and being structured to turn the ice tray;

a frame body which supports the ice tray and the drive unit; and a cold air duct which connects an opening formed in the frame body with the cold air supply port, wherein the frame body further comprises a wall part which is provided in the frame body at a second end side in the longitudinal direction of the ice tray so as to face the drive unit on an opposite side to the first end side, the wall part comprises the opening through which the cold air is sent to the ice tray, the drive unit is structured to turn the ice tray by a predetermined angle from an ice making position, the frame body comprises an abutting part which is abutted with a projection provided in the ice tray to apply a force in a twisting direction to the ice tray in a state that the ice tray has been turned by the predetermined angle, and the frame body is formed with a frame body side relief part and the cold air duct is formed with an air duct side relief part, both of which avoid an interference with the ice tray in the state that the ice tray has been turned by the predetermined angle.

* * * * *